United States Patent [19]

Kobayashi et al.

[11] 4,229,276

[45] Oct. 21, 1980

[54] VIBRATORY PLATING APPARATUS

[75] Inventors: Hisamine Kobayashi, Nagoya; Motoo Kawasaki, Hirakata; Shozo Mizumoto, Takarazuka; Hidemi Nawafune, Takatsuki; Sadamasa Suzuki, Tatsuta, all of Japan

[73] Assignees: Shikishima Tipton Manufacturing Co. Ltd., Nagoya; Motoo Kawasaki, Hirakata, both of Japan

[21] Appl. No.: 16,144

[22] Filed: Feb. 28, 1979

[51] Int. Cl.[2] ..... C25D 17/02; C25D 17/26

[52] U.S. Cl. ..... 204/222; 204/273

[58] Field of Search ..... 204/222, 223, 213, 273, 204/201

[56] References Cited

U.S. PATENT DOCUMENTS

| | | | |
|---|---|---|---|
| 3,397,126 | 8/1968 | Gilbert | 204/222 |
| 3,420,766 | 1/1969 | Michelson | 204/222 |
| 3,425,926 | 2/1969 | Hojyo | 204/213 |
| 3,649,490 | 3/1972 | Nolan et al. | 204/222 |
| 3,699,014 | 10/1972 | Eisner | 204/222 |

*Primary Examiner*—T. M. Tufariello

*Attorney, Agent, or Firm*—Wenderoth, Lind & Ponack

[57] ABSTRACT

A vibratory plating apparatus having a plating liquid in a plating container, a base on which the container is mounted for vibrating movement, and a lid for the top of the container. The bottom of the container has an arcuate bottom. A vibration motor vibrates the container and electrodes are disposed within the container. With this plating apparatus, workpieces can be plated uniformly in a very short period of time at a high current density and with a small amount of plating liquid. Moreover, it eliminates troublesome steps of manually suspending and removing workpieces from hangers.

8 Claims, 8 Drawing Figures

VIBRATORY PLATING APPARATUS

BACKGROUND OF THE INVENTION

1. Field of the Invention

The present invention relates to a vibratory plating apparatus which improves plating efficiency by vibrating a plating container to maintain a uniform concentration of metal ions in the vicinity of cathodes.

2. Description of the Prior Art

In a conventional apparatus of this kind, abrasive chips, a plating liquid and workpieces are placed in a vibratory container and an electric current is applied to the plating liquid to effect the plating of the workpieces. Since abrasive chips are disposed in the plating liquid in this apparatus, the lining on the inner surface of the plating container and the electrodes installed therein is likely to be worn in a short time and the current efficiency is low. Moreover, the plated surfaces of workpieces are easily contaminated with broken pieces of abrasive chips. Therefore, this kind of apparatus has not satisfied practical needs.

In a conventional plating apparatus using a barrel, workpieces are installed in a plating liquid in the barrel and the barrel is rotated or rocked to bring the workpieces into sliding contact with cathodes to subject the workpieces to electrodeposition. Barrel type plating apparatuses include one using an open-top bottle type barrel which is rotated while being inclined, and another one using a rectangular or cylindrical barrel having small apertures in the entire wall thereof, horizontally disposed in a plating liquid, and rotated or rocked with the plating liquid to effect the plating of the workpieces. The former is called an inclined barrel type plating apparatus and the latter a horizontal barrel type plating apparatus. In the inclined barrel type plating apparatus, the temperature and the concentration of the plating baths are frequently subject to changes, the insertion and withdrawal of workpieces cannot be easily carried out and anodes having a large surface area cannot be employed.

In the horizontal barrel type plating apparatus, an electric current flows through small apertures in the side wall of the barrel. Thus, the plating container requires a far higher voltage than the plating container used in other plating apparatuses in which workpieces are suspended in a plating liquid. As a result, a large amount of energy is consumed, and sparks jump across the contacts of cathode lead wires and workpieces so that the surfaces of workpieces are burnt or have holes made therein by burning. In addition, the power source and other parts will often be damaged and the plating operation cannot be conducted smoothly in many cases.

Plating with 3–4$\mu$ of nickel cannot be carried out efficiently in the horizontal barrel type plating apparatus or it usually requires 60–90 minutes of electrodeposition even if the diameter of apertures in the side wall of the plating barrel are enlarged. In addition, the amount of plating liquid removed from the plating barrel in this apparatus is larger than that in a widely used plating method carried out with workpieces suspended in a plating liquid. This causes the composition of the plating bath to be changed. In other words, quality control cannot be carried out easily. This large amount of plating liquid removed from the plating barrel has caused troubles in the treatment of the waste water for preventing the occurrence of environmental pollution, and has adversely affected the economy of the plating process.

These conventional plating apparatuses have many other drawbacks than those described above. They have a low productivity and require a large floor space. Consequently, the quantity and dimensions of workpieces to be plated are limited. In fact, the conventional barrel type plating apparatuses have many problems yet to be solved including the abovementioned problem of treating waste water. Namely, in a conventional barrel type plating apparatus, the plating of workpieces cannot be satisfactorily carried out unless they are soaked completely in a large amount of plating liquid which is rotated or rocked. Moreover, the plated layer on the workpieces is not a uniform thickness at each part of their surfaces because of unsufficient agitation of the plating liquid.

SUMMARY OF THE INVENTION

An object of the present invention is to eliminate the drawbacks described hereinbefore with regard to the conventional plating apparatuses.

Another object of the present invention is to provide an ideal vibratory plating apparatus in which only a plating liquid and workpieces only are placed in a vibratory plating container and an electric current is applied to the plating liquid for carrying out the plating process.

Still another object of the present invention is to provide a vibratory plating apparatus which enables carrying out a plating processes at a high efficiency which is double that of a conventional apparatus, because the workpieces are rolled and displaced in the bottom portion of a vibratory container containing a quantity of a plating liquid which is equal to or less than a third of that in a conventional apparatus.

Still another object of the present invention is to provide improved vibratory plating apparatus which produces a uniform plated layer thickness at all parts of the workpiece surfaces by imparting vibratory action to the plating liquid to agitate it sufficiently.

The above and other objects as well as advantageous features of the invention will become apparent from the following description of the preferred embodiments taken in conjunction with the accompanying drawings.

DESCRIPTION OF THE PREFERRED EMBODIMENTS

Embodiments of the present invention will be described in detail with reference to the accompanying drawings.

Figure 1:
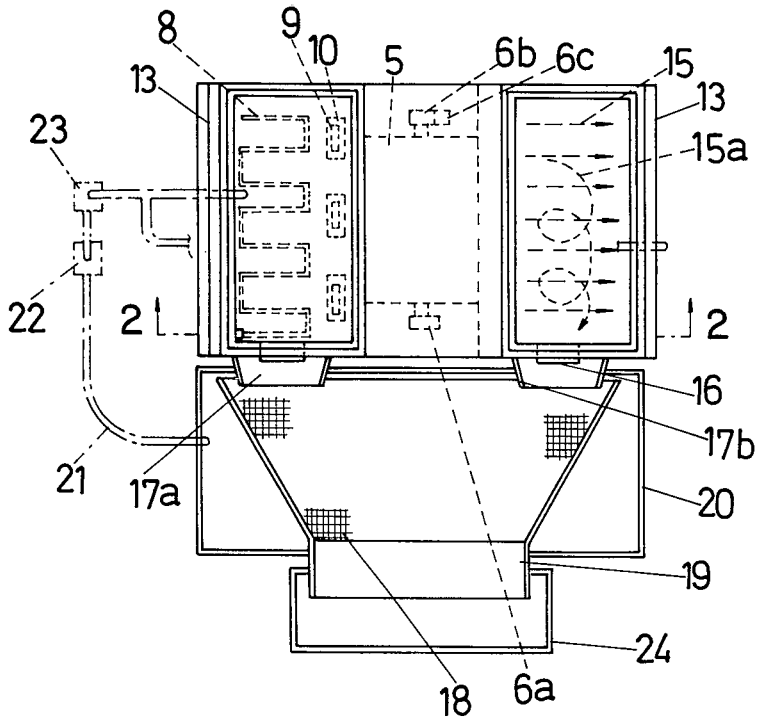
FIG. 1 is a plan view of a duplex tub type vibratory plating apparatus.
Figure 2:
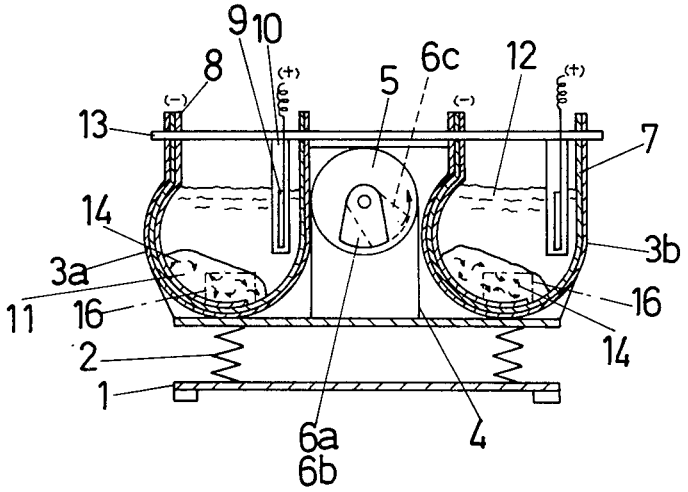
FIG. 2 is a cross-sectional view taken along the line 2—2 in FIG. 1.

In the duplex tub type plating apparatus shown in FIGS. 1 and 2, both of the containers are in the form of tubs as shown and are operatively connected and have the same construction. The left tub in the drawing shows the construction of the tub, and the right tub shows the movement of workpieces therein.

The parts, workpieces, and arrows showing the directions of the flow of a mass in the plating container, which are common to all of those drawings, are represented by the same reference numerals.

Referring to FIGS. 1 and 2, tubs 3*a* and 3*b* are mounted on springs 2 which are provided on a base 1. Unbalanced weights 6*a* and 6*b* are secured to the opposite ends of a shaft of a vibratory motor 5 disposed between the tubs 3*a* and 3*b*. Anode plates 9 covered with films 10 are immersed in a plating liquid 12 in the tubs 3*a* and 3*b*, the inner surfaces of which are lined with electrically insulating members 7 made of rubber, vinyl, or urethane. These anode plates 9 are secured to lids 13. Cathode plates 8 are disposed on the opposite side facing the anode plates 9 in the tubs 3*a* and 3*b*, and are secured to the lid 13 in the same manner as the anode plates 9 with the upper end portions thereof projecting out of the tubs 3*a* and 3*b*. Conductors from an external power source (not shown) are connected to the anode plates 9 and cathode plates 8 so that an electric current can be made to flow therethrough, respectively. A plating liquid is contained in the tubs 3*a* and 3*b*. Workpieces 11 in the plating tubs 3*a* and 3*b* to which an electric current is supplied may be free or fixed to the cathode plates 8. The workpieces 11 gathered in the bottom portions of the tubs 3*a* and 3*b* are rolled and circularly transferred individually and independently of one another as shown by the arrows 14 (in FIG. 2) when the vibratory motor 5 is driven. This causes the density of ions around the workpieces 11 to be uniform at all times, and the workpieces 11 are plated uniformly at a high speed. In this case, the general movements of the contents of the vibratory plating tubs 3*a* and 3*b* are affected by the lead angle of the unbalanced weights 6*a* and 6*b*. When there is no lead angle between the unbalanced weights 6*a* and 6*b*, the contents of the tubs 3*a* and 3*b* are circulated (in one direction) in planes at right angles to the axes of the tubs 3*a* and 3*b* as shown by arrows 15 in FIG. 1. When an lead angle of approximately 15°–90°, preferably 30°, is provided in the direction of rotation of the contents of the tubs 3*a* and 3*b* to the unbalanced weight 6*b* by moving the same to a position 6*c* after a plating process has been completed, the contents of the tubs 3*a* and 3*b* are moved with a spiral motion of a large pitch in the direction of the arrow 15*a*, and are discharged from discharge ports 17*a* and 17*b*. Discharged workpieces 11 are fed into a receptacle 24 via a screen 18 and an outlet 19, while the discharged plating liquid is collected in a tank 20 disposed under the screen 18. The liquid collected in the tank 20 then flows into a conduit 21 connected at one end to the tank 20 and at the other end to the tubs 3*a* and 3*b*, and is filtered in a filter 22. The filtered liquid is then returned to the tubs 3*a* and 3*b* by means of a pump 23 for use in the next cycle of the plating process.

In the apparatuses shown in FIGS. 3–8, the contents of a bowl 3 are circulated in planes including the vertical axis thereof. When an lead angle of 15°–45°, preferably 30°, is given to a lower unbalanced weight 6*a* in the direction of rotation of the contents of the bowl 3 with respect to an upper unbalanced weight 6*b*, during the plating operation workpieces are independently rolled and transferred as indicated by arrows 14*a*, 14*b* and 14*c* and the general contents of the bowl 3 are circulated with a spiral motion of a small pitch as indicated by arrows 15*b*, 15*c*, and 15*d*. In order to separate the workpieces after the plating operation has been completed, a lead angle of 60°–120°, preferably 90°, in the direction of rotation of the contents of the bowl 3 is given to the lower unbalanced weight to impel the contents of the bowl 3, and the contents are moved with a spiral motion of a large pitch as indicated by the broken-line arrow 15*a*. A lead angle of 15°–45°, preferably 30°, to be given to the lower unbalanced weight may then be chosen for the plating operations. On the contrary, a lead angle of 60°–120°, preferably 90°, may be chosen for withdrawing the contents of the bowl after the plating operation has been completed. These lead angles may be utilized for automatically vibrating the plating liquid. In the case where workpieces are fixed to the cathodes, a movable weight for withdrawing the workpieces is not needed and in that case a, fixed unbalanced weight may be used for causing the vibration of the plating liquid.

According to the present invention described above, the plating efficiency and plating rate can be improved by use of the vibrating container. Namely, according to the present invention, a larger quantity of workpieces can be loaded at one time in a plating container, and the current efficiency can be improved since a container having small apertures in the wall thereof which shelters the electric current can be omitted. In addition, the workpieces in the plating container are vibrated so as to be rolled and transferred independently of one another and simultaneously circulated with a spiral motion of a small pitch as shown by arrows 15. This causes the density of ions around the workpieces to be uniform so that the plating operation can be speeded up.

Figure 3:
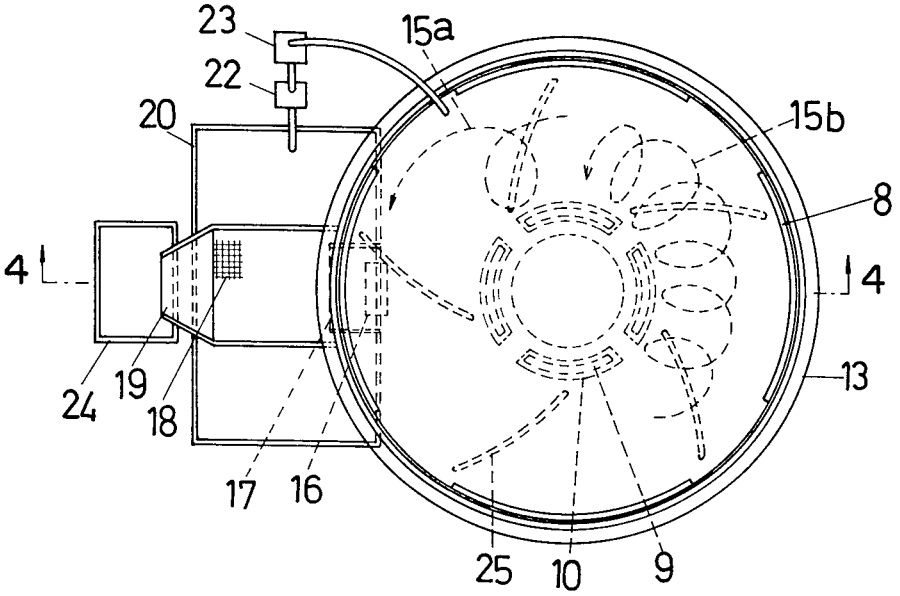
FIG. 3 is a plan view of an annular vibratory plating apparatus.
Figure 4:
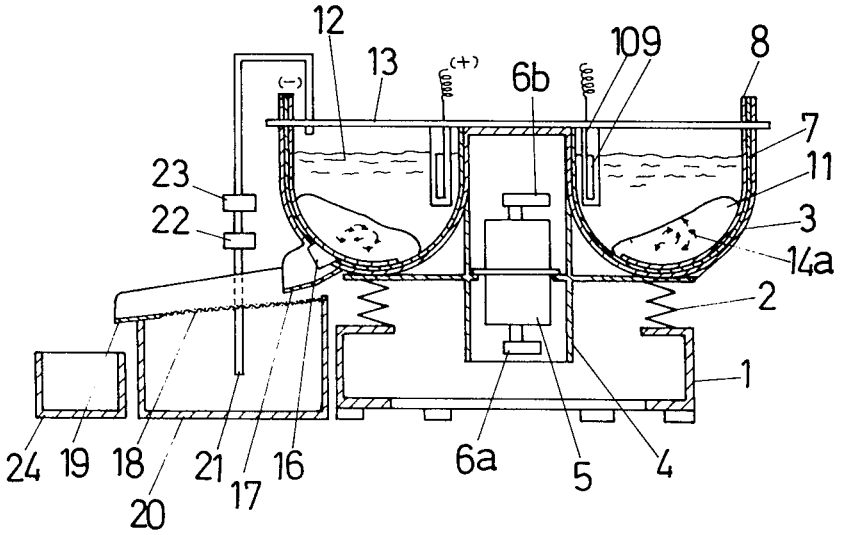
FIG. 4 is a cross-sectional view taken along the line 4—4 of FIG. 3.
Figure 5:
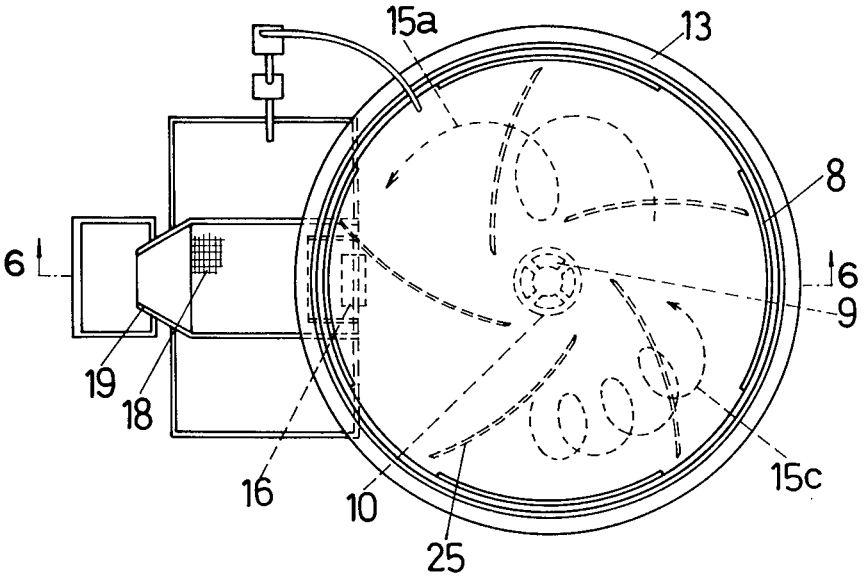
FIG. 5 is a plan view of a core-less vibratory plating apparatus.
Figure 6:
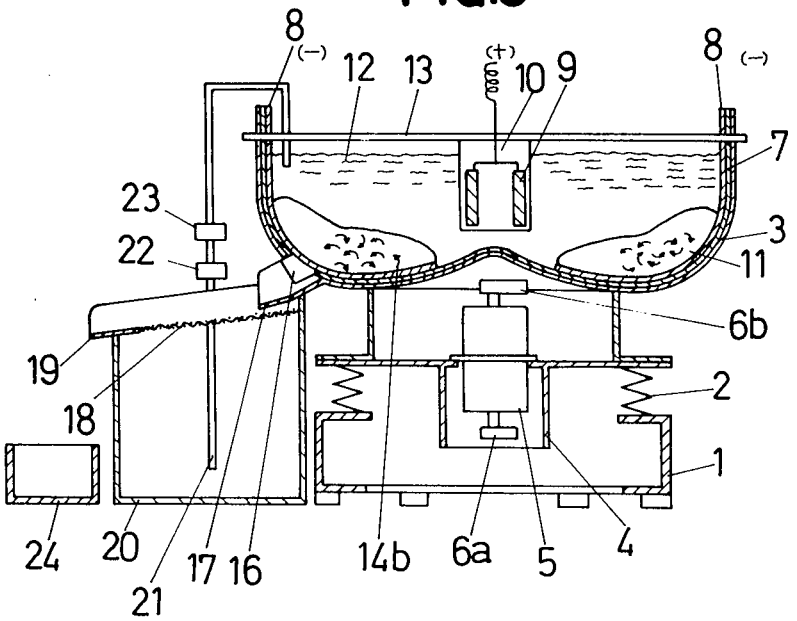
FIG. 6 is a cross-sectional view taken along the line 6—6 of FIG. 6.
Figure 7:
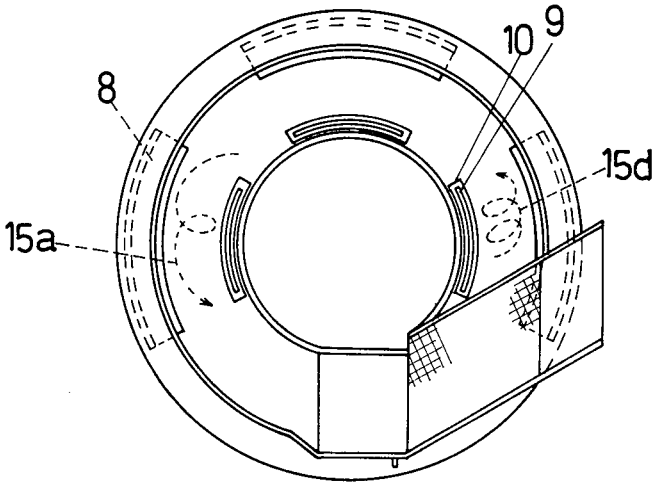
FIG. 7 is a plan view of a spiral vibratory plating apparatus.
Figure 8:
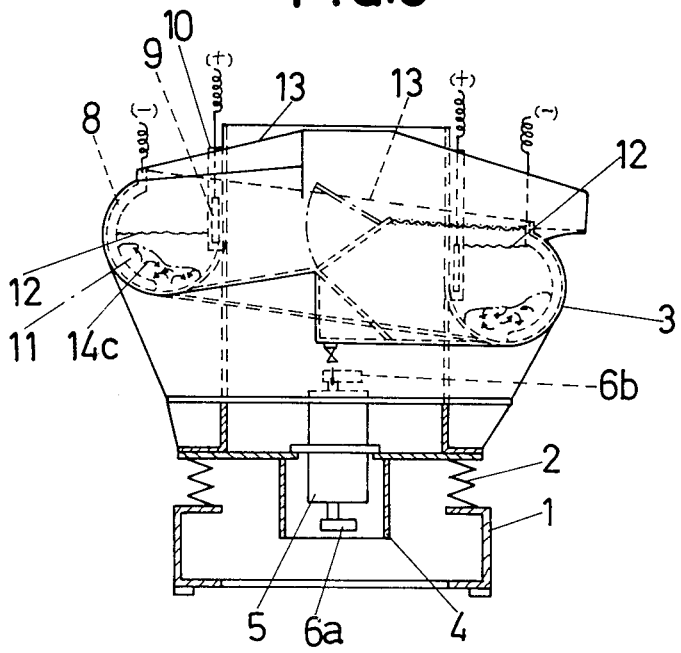
FIG. 8 is a front elevational view of the plating apparatus shown in FIG. 7.

Since workpieces are rolled and transferred whether a deflector 25 such as shown in FIGS. 3 and 5 is provided in the container 3 or not, any diffusion layer formed on the surface of cathodes during the electrolysis is thin. As a result, an electric current of a high density can be used. Therefore, the plating apparatus using plating containers according to the present invention increases the productivity to a higher level.

In a conventional plating method using a plating container, the plating liquid is withdrawn through the apertures in the side wall of the container after the electrolysis process has been completed, and it has therefore been very difficult to withdraw the plating liquid completely. However, according to the plating method of the present invention, workpieces alone can be sent to the following step and thus, the quantity of the plating liquid removed from the plating container is greatly reduced. This means that the loss of the plating liquid can be kept to a minimum.

In a generally used plating apparatus, in which workpieces are suspended in a plating liquid, it is the most troublesome at present to manually suspend the workpieces and remove the same. This troublesome step and the involved labor can be eliminated by the plating apparatus according to the present invention.

In a generally used plating apparatus referred to above in which a plating barrel is used only, comparatively small-size workpieces can be treated because with larger workpieces indentions are formed in the workpieces due to their violent impact with each other and the machine, and because of the limited mechanical strength of the machine to resist such impact. In the plating apparatus according to the present invention, however, comparatively large workpieces, which are at present plated while being suspended from hooks, can also be treated in a plating container.

Unlike a conventional plating apparatus having a plating barrel, the plating apparatus according to the present invention transfers only plated workpieces to the next step, and accordingly, the plating operation can be automated. In addition, the plating apparatus according to the present invention can be substantially completely sealed, thereby improving the working environment greatly. The plating apparatus according to the present invention has no gears and belts, and has a very simple and rugged construction. Moreover, the plating container in the apparatus is not rotated, and electrode contact connections can be stationary. Unlike a conventional plating apparatus in which abrasive chips are used, the plating apparatus according to the present invention causes no decrease in current efficiency, and the plated surface of a workpiece is not contaminated with small fragments of abrasive chips. In fact, the present invention provides an ideal plating apparatus which carries out a plating process at a high rate.

Plating materials usable in the method and apparatus according to the present invention are mainly copper, nickel, zinc and chromium. An example of the present invention is shown and described below.

EXAMPLE

Apparatus: Tub-type vibratory plating apparatus.
Capacity: 2 liters
Plating liquid: Solution of nickel, 1.5 liter watt bath; and 2.5 g/liter of 1,3,6-naphthalene sodium sulfonate and 0.025 g/liter of 1,4 butyne diole as brighteners.
Test pieces: 2000 dry cell caps of 10 mm (dia.)×2.7 mm.
Frequency: 800–1500 cpm
Amplitude: 0.5–3 mm
Amperage: 4 A
Thickness of plating:
Target thickness: 5.3μ
Average thickness obtained: 5.29μ
Plating time: 3.5 hours The results of the experiment conducted under the above-described conditions are as follows. The variance of thickness of plating on the test pieces is small. The plating time is required to half the time required in a conventional plating apparatus. Manual suspending of workpieces can be eliminated. The surface of the workpieces is uniformly plated with the same thickness at all their parts. Even light workpieces like the test pieces used in this experiment can be uniformly rolled in the bottom portion of the vibratory container without floating. The plating operation can be conducted at a very high efficiency at under a high current density.

The present invention is not, of course, limited to the above embodiments; it may be modified within the scope of the appended claims.

What is claimed is:

1. An apparatus for plating workpieces in a plating container, which comprises:

a base;

a vibratory plating container means resiliently mounted on said base for vibratory movement, said container means having a lid covering the top and having a bottom with a concavely arcuate cross-section;

a vibration-generating motor connected with said container means for causing vibration of said container means; for causing workpieces in said container means to roll and to be transferred in a direction along said container means parallel to said bottom; and electrodes of opposite polarities disposed within said container means;

said container means having a discharge port on one side of the arcuate bottom for discharging a mixture of plated workpieces and plating liquid;

a screening means below and separate from said container means for receiving said mixture from said discharge port and separating workpieces from the plating liquid; and liquid return means connected between said container means and said screening means for returning plating liquid to said container means.

2. An apparatus as claimed in claim 1 in which said container means is a pair of side by side horizontally positioned tubs, said vibration-generating motor being positioned between said tubs.

3. An apparatus as claimed in claim 1 in which said container means is a horizontally positioned annular tub, said vibration-generating motor being positioned in the center of said tub.

4. An apparatus as claimed in claim 1 in which said container means is an open-topped tub having an annular groove around the periphery of the bottom thereof forming said concavely arcuate cross-section, and said vibration-generating motor being positioned below the center of said tub.

5. An apparatus as claimed in claim 1 in which said container means is a spiral tub and said vibration-generating motor being positioned below the center of said tub.

6. An apparatus as claimed in claim 1, wherein said electrodes are secured to said lid.

7. An apparatus as claimed in claim 6, wherein one of said electrodes is a cathode positioned in the path of the individual workpieces which are moved along the inner wall of said container means during vibration of said container.

8. An apparatus as claimed in claim 1, wherein said vibration-generating motor has a rotary shaft and a pair of unbalanced weights secured to the respective ends of said rotary shaft for causing vibration of said container means during rotation of said motor.

* * * * *